US007712529B2

(12) United States Patent
Dusterhoft et al.

(10) Patent No.: US 7,712,529 B2
(45) **Date of Patent: *May 11, 2010**

(54) SAND CONTROL SCREEN ASSEMBLY AND METHOD FOR USE OF SAME

(75) Inventors: Ronald Glen Dusterhoft, Katy, TX (US); Carl Bismark Ferguson, La Porte, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 146 days.

This patent is subject to a terminal disclaimer.

(21) Appl. No.: 11/970,682

(22) Filed: Jan. 8, 2008

(65) Prior Publication Data

US 2009/0173490 A1 Jul. 9, 2009

(51) Int. Cl.
*E21B 43/10* (2006.01)

(52) U.S. Cl. ..... 166/278; 166/380; 166/51; 166/236

(58) Field of Classification Search ..... 166/278, 166/380, 51, 228, 236
See application file for complete search history.

(56) References Cited

U.S. PATENT DOCUMENTS

| | | | |
|---|---|---|---|
| 921,337 | A | 5/1909 | Archer |
| 1,811,235 | A | 1/1926 | King |
| 2,945,541 | A | 7/1960 | Maly et al. |
| 2,981,333 | A | 4/1961 | Miller et al. |
| 3,390,724 | A | 7/1968 | Caldwell |
| 4,585,064 | A | 4/1986 | Graham et al. |
| 4,670,501 | A | 6/1987 | Dymond et al. |
| 5,249,627 | A | 10/1993 | Harms et al. |
| 5,833,000 | A | 11/1998 | Weaver et al. |
| 5,836,392 | A | 11/1998 | Urlwin-Smith |
| 5,839,510 | A | 11/1998 | Weaver et al. |
| 5,853,048 | A | 12/1998 | Weaver et al. |
| 5,874,490 | A | 2/1999 | Arora et al. |
| 5,934,376 | A | 8/1999 | Nguyen et al. |

(Continued)

FOREIGN PATENT DOCUMENTS

EP 1792049 A1 6/2006

(Continued)

OTHER PUBLICATIONS

Dave Allison; Swellable rubber technology joins cementing; E&P. Issue (May 2007); (pp. 1-2).

(Continued)

*Primary Examiner*—William P Neuder
(74) *Attorney, Agent, or Firm*—Lawrence R. Youst

(57) ABSTRACT

A sand control screen assembly (40) includes a base pipe (44) having a plurality of openings (45) in a sidewall portion thereof and a swellable material layer (46) disposed exteriorly of the base pipe (44) and having a plurality of openings (47) that correspond to the openings (45) of the base pipe (44). A plurality of telescoping perforations (48) are operably associated with the openings (45) of the base pipe (44) and at least partially disposed within the corresponding openings (47) of the swellable material layer (46). A filter medium (56) is disposed within each of the telescoping perforations (48). In operation, radial expansion of the swellable material layer (46), in response to contact with an activating fluid, causes the telescoping perforations (48) to radially outwardly extend.

19 Claims, 10 Drawing Sheets

U.S. PATENT DOCUMENTS

| | | | |
|---|---|---|---|
| 6,003,600 | A | 12/1999 | Nguyen et al. |
| 6,192,986 | B1 | 2/2001 | Urlwin-Smith |
| 6,196,317 | B1 | 3/2001 | Hardy |
| 6,263,966 | B1 | 7/2001 | Haut et al. |
| 6,302,207 | B1 | 10/2001 | Nguyen et al. |
| 6,311,773 | B1 | 11/2001 | Todd et al. |
| 6,427,775 | B1 | 8/2002 | Dusterhoft et al. |
| 6,439,309 | B1 | 8/2002 | Matherly et al. |
| 6,446,722 | B2 | 9/2002 | Nguyen et al. |
| 6,457,518 | B1 | 10/2002 | Castano-Mears et al. |
| 6,481,494 | B1 | 11/2002 | Dusterhoft et al. |
| 6,540,022 | B2 | 4/2003 | Dusterhoft et al. |
| 6,543,545 | B1 | 4/2003 | Chatterji et al. |
| 6,557,635 | B2 | 5/2003 | Nguyen et al. |
| 6,571,872 | B2 | 6/2003 | Dusterhoft et al. |
| 6,575,245 | B2 | 6/2003 | Hurst et al. |
| 6,582,819 | B2 | 6/2003 | McDaniel et al. |
| 6,588,507 | B2 | 7/2003 | Dusterhoft et al. |
| 6,653,436 | B2 | 11/2003 | Back et al. |
| 6,677,426 | B2 | 1/2004 | Noro et al. |
| 6,698,519 | B2 | 3/2004 | Nguyen et al. |
| 6,702,019 | B2 | 3/2004 | Dusterhoft et al. |
| 6,719,051 | B2 | 4/2004 | Hailey, Jr. et al. |
| 6,755,245 | B2 | 6/2004 | Nguyen et al. |
| 6,766,862 | B2 | 7/2004 | Chatterji et al. |
| 6,772,837 | B2 | 8/2004 | Dusterhoft et al. |
| 6,854,522 | B2 | 2/2005 | Brezinski et al. |
| 6,886,634 | B2 | 5/2005 | Richards |
| 6,899,176 | B2 | 5/2005 | Hailey, Jr. et al. |
| 6,956,086 | B2 | 10/2005 | Back et al. |
| 7,013,979 | B2 | 3/2006 | Richard |
| 7,036,587 | B2 | 5/2006 | Munoz et al. |
| 7,096,945 | B2 | 8/2006 | Richards et al. |
| 7,108,062 | B2 | 9/2006 | Castano-Mears et al. |
| 7,108,083 | B2 | 9/2006 | Simonds et al. |
| 7,114,560 | B2 | 10/2006 | Nguyen et al. |
| 7,131,491 | B2 | 11/2006 | Blauch et al. |
| 7,153,575 | B2 | 12/2006 | Anderson et al. |
| 7,191,833 | B2 | 3/2007 | Richards |
| 7,204,316 | B2 | 4/2007 | Dusterhoft et al. |
| 7,216,706 | B2 | 5/2007 | Echols et al. |
| 7,431,098 | B2 | 7/2007 | Ohmer et al. |
| 7,252,142 | B2 | 8/2007 | Brezinski et al. |
| 7,258,166 | B2 | 8/2007 | Russell |
| 7,264,047 | B2 | 9/2007 | Brezinski et al. |
| 7,267,171 | B2 | 9/2007 | Dusterhoft et al. |
| 7,299,875 | B2 | 11/2007 | Nguyen et al. |
| 7,299,882 | B2 | 11/2007 | Brezinski et al. |
| 7,320,367 | B2 | 1/2008 | Brezinski et al. |
| 7,520,327 | B2 | 1/2008 | Surjaatmadja |
| 7,350,579 | B2 | 4/2008 | Clark et al. |
| 7,363,986 | B2 | 4/2008 | Brezinski et al. |
| 7,373,991 | B2 | 5/2008 | Vaidya et al. |
| 7,387,165 | B2 | 6/2008 | Lopez de Cardenas et al. |
| 7,392,847 | B2 | 7/2008 | Gatlin et al. |
| 7,404,437 | B2 | 7/2008 | Brezinski et al. |
| 7,426,962 | B2 | 9/2008 | Moen et al. |
| 7,451,815 | B2 | 11/2008 | Hailey |
| 7,493,947 | B2 | 2/2009 | Ross |
| 7,511,487 | B2 | 3/2009 | Badry et al. |
| 2004/0060695 | A1 | 4/2004 | Castano-Mears et al. |
| 2004/0134656 | A1 | 7/2004 | Richards |
| 2005/0077052 | A1 | 4/2005 | Ohmer |
| 2005/0126776 | A1 | 6/2005 | Russell |
| 2005/0277554 | A1 | 12/2005 | Blauch et al. |
| 2005/0284633 | A1 | 12/2005 | Richard |
| 2006/0042801 | A1 | 3/2006 | Hackworth et al. |
| 2006/0090903 | A1 | 5/2006 | Gano et al. |
| 2006/0108114 | A1* | 5/2006 | Johnson ..... 166/276 |
| 2006/0124310 | A1 | 6/2006 | Lopez de Cardenas et al. |
| 2006/0175065 | A1 | 8/2006 | Ross |
| 2006/0185849 | A1 | 8/2006 | Edwards et al. |
| 2006/0186601 | A1 | 8/2006 | Lopez |
| 2007/0012436 | A1 | 1/2007 | Freyer |
| 2007/0114018 | A1 | 5/2007 | Brezinski et al. |
| 2007/0131422 | A1 | 6/2007 | Gatlin et al. |
| 2007/0131425 | A1 | 6/2007 | Gatlin et al. |
| 2007/0131434 | A1 | 6/2007 | MacDougall et al. |
| 2007/0257405 | A1 | 11/2007 | Freyer |
| 2007/0272411 | A1 | 11/2007 | Lopez de Cardenas et al. |
| 2008/0006405 | A1 | 1/2008 | Rickman et al. |
| 2008/0035349 | A1* | 2/2008 | Richard ..... 166/308.1 |
| 2008/0078561 | A1 | 4/2008 | Chalker et al. |
| 2008/0093086 | A1 | 4/2008 | Courville et al. |
| 2008/0125335 | A1 | 5/2008 | Bhavsar |
| 2008/0149351 | A1 | 6/2008 | Marya et al. |
| 2008/0156492 | A1 | 7/2008 | Bosma et al. |
| 2008/0194717 | A1 | 8/2008 | Vaidya et al. |
| 2008/0217022 | A1 | 9/2008 | Simonds et al. |
| 2008/0283240 | A1 | 11/2008 | Baaijens et al. |
| 2009/0173497 | A1* | 7/2009 | Dusterhoft ..... 166/276 |

FOREIGN PATENT DOCUMENTS

| | | | |
|---|---|---|---|
| EP | 1759086 | A1 | 6/2007 |
| GB | 2421527 | A | 6/2006 |
| WO | WO-96/26350 | | 8/1996 |
| WO | WO-03/052238 | A1 | 7/2003 |
| WO | 2004022911 | | 3/2004 |
| WO | WO-2004/018836 | A1 | 3/2004 |
| WO | WO-2005/056977 | A1 | 6/2005 |
| WO | WO-2005/100743 | A1 | 10/2005 |
| WO | WO-2005/124091 | A1 | 12/2005 |
| WO | WO-2006/003112 | A1 | 1/2006 |
| WO | WO-2006/003113 | A1 | 1/2006 |
| WO | WO-2006/113500 | A1 | 10/2006 |
| WO | 2008122809 | | 3/2007 |
| WO | 2007092082 | | 8/2007 |
| WO | 2007092083 | | 8/2007 |
| WO | 2007126496 | | 11/2007 |
| WO | 2008070674 | | 6/2008 |
| WO | 2008122809 | | 10/2008 |
| WO | 2009001073 | | 12/2008 |

OTHER PUBLICATIONS

Drew Hembling; Aramco uses swell packers to enable smart open-hole, multilateral completions for EOR; Completions article (Sep./Oct. 2007); (pp. 108-114).

Cleanable Media Produts; http://www.purolator-facet.com/media.htm; (Nov. 27, 2007); (pp. 1-3).

Karen Bybee; Swelling Packers Solve Zonal-Isolation Challenge in Oman High-Pressure Wells; HP/HT hallenges article; (Mar. 2007); (pp. 75-79).

International Search Report and Written Opinion, International Searching Authority European Patent Office, Aug. 5, 2009.

PCT Search Report and Written Opinion (Oct. 29, 2009).

International Search Report and Written Opinion - PCT/US2009/054957, International Searching Authority, Dec. 12, 2009.

* cited by examiner

SAND CONTROL SCREEN ASSEMBLY AND METHOD FOR USE OF SAME

TECHNICAL FIELD OF THE INVENTION

This invention relates, in general, to controlling the production of particulate materials from a hydrocarbon formation and, in particular, to a sand control screen assembly having a swellable material layer that is operable to radially extend a plurality of telescoping perforations having particulate filtering capability into contact with the formation.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate materials. For example, the particulate materials cause abrasive wear to components within the well, such as tubing, pumps and valves. In addition, the particulate materials may partially or fully clog the well creating the need for an expensive workover. Also, if the particulate materials are produced to the surface, they must be removed from the hydrocarbon fluids by processing equipment at the surface.

One method for preventing the production of such particulate materials to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material, such as gravel, is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

In certain open hole completions where gravel packing may not be feasible, attempts have been made to use expandable sand control screens. Typically, expandable sand control screens are designed to not only filter particulate materials out of the formation fluids, but also provide radial support to the formation to prevent the formation from collapsing into the wellbore. It has been found, however, that conventional expandable sand control screens are not capable of contacting the wall of the wellbore along their entire length as the wellbore profile is not uniform. More specifically, due to the process of drilling the wellbore and heterogeneity of the downhole strata, washouts or other irregularities commonly occur which result in certain locations within the wellbore having larger diameters than other areas or having non circular cross sections. Thus, when the expandable sand control screens are expanded, voids are created between the expandable sand control screens and the irregular areas of the wellbore. In addition, it has been found that the expansion process undesirably weakens such sand control screens.

More recently, attempts have been made to install sand control screens that include telescoping screen members. Typically, hydraulic pressure is used to extend the telescoping screen members radially outwardly toward the wellbore. This process requires providing fluid pressure through the entire work string that acts on the telescoping members to shift the members from a position partially extending into to production string to the radially extended position. It has been found, however, that in substantially horizontal production intervals, the telescoping screen members may not properly deploy, particularly along the portion of the production string resting on the bottom surface of the wellbore. Failure to fully extend all the telescoping screen members results in a non uniform inner bore which may prevent the passage of tools therethrough.

Therefore, a need has arisen for a sand control screen assembly that prevents the production of particulate materials from a well that traverses a hydrocarbon bearing subterranean formation without the need for performing a gravel packing operation. A need has also arisen for such a sand control screen assembly that provides radial support to the formation without the need for expanding metal tubulars. Further, a need has arisen for such a sand control screen assembly that is suitable for operation in open hole completions and horizontal production intervals.

SUMMARY OF THE INVENTION

The present invention disclosed herein comprises a sand control screen assembly that prevents the production of particulate materials from a well that traverses a hydrocarbon bearing subterranean formation. The sand control screen assembly of the present invention achieves this result without the need for performing a gravel packing operation. In addition, the sand control screen assembly of the present invention provides radial support to the formation without the need for expanding metal tubulars and is suitable for operation in open hole completions and horizontal production intervals.

In one aspect, the present invention is directed to a sand control screen assembly including a base pipe having a plurality of openings that allow fluid flow therethrough and a swellable filter media disposed exteriorly of the base pipe and surrounding the plurality of openings. The swellable filter media is radially extendable between a first configuration and a second configuration in response to contact with an activating fluid. The swellable filter media is operable to allow fluid flow therethrough and prevent particulate flow of a predetermined size therethrough.

In one embodiment, the activating fluid is a hydrocarbon. In another embodiment, the swellable filter media is formed from a material selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene. In this embodiment, the swellable material may contain pores having diameters of less than 1 mm. In yet another embodiment, the swellable filter media is operable to swell into contact with a surface of a formation when the sand control screen assembly is disposed in a well and the swellable filter media is in the second configuration. In one embodiment, the swellable filter media may include filter medium layer and a swellable material layer. In another embodiment, the swellable filter media may include a filter medium layer positioned between two swellable material layers.

In another aspect, the present invention is directed to a sand control screen assembly that includes base pipe having at least one opening in a sidewall portion thereof and a swellable material layer disposed exteriorly of the base pipe and having at least one opening corresponding to the at least one opening of the base pipe. A telescoping perforation is operably associated with the at least one opening of the base pipe and is at least partially disposed within the at least one opening of the swellable material layer. A filter medium is disposed within the telescoping perforation. In operation, radial expansion of the swellable material layer, in response to contact with an activating fluid, causes the telescoping perforation to radially outwardly extend.

In one embodiment, a face plate located at the distal end of the telescoping perforation substantially transverse to a longitudinal axis of the telescoping perforation. In this embodiment, the face plate may be positioned on the exterior surface of the swellable material layer. In another embodiment, the filter medium is recessed radially inwardly from the distal end of the telescoping perforation. In this embodiment, the filter medium further may be a multi-layer woven wire mesh. In yet another embodiment, the telescoping perforation may be a telescoping tubular perforation. In a further embodiment, the activating fluid may be a hydrocarbon and the swellable material may be selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

In a further aspect, the present invention is directed to a sand control screen assembly that includes a base pipe having a plurality of openings in a sidewall portion thereof and defining an internal flow path. A swellable material layer is disposed exteriorly of the base pipe and has a plurality of openings that correspond to the openings of the base pipe. A plurality of telescoping perforations is operably associated with the openings of the base pipe and at least partially disposed within the corresponding openings of the swellable material layer. The telescoping perforations provide fluid flow paths between a fluid source disposed exteriorly of the base pipe and the interior flow path. A filter medium is disposed within each of the telescoping perforations. In operation, radial expansion of the swellable material layer, in response to contact with an activating fluid, causes the telescoping perforation to radially outwardly extend.

In a further aspect, the present invention is directed to a method for making a sand control screen assembly. The method includes providing a base pipe having an interior flow path, disposing a swellable material layer on the exterior of the base pipe, forming corresponding openings in the base pipe and the swellable material layer and operably associating a plurality of telescoping perforations having filter media with the openings of the base pipe and at least partially disposing the telescoping perforations within the corresponding openings of the swellable material layer such that upon radial expansion of the swellable material layer, the telescoping perforations are radially outwardly extendable.

The method may also include forming the openings after the swellable material layer is disposed on the exterior of the base pipe, drilling holes through the swellable material layer and the base pipe and threadably coupling the telescoping perforations with the openings of the base pipe.

In another aspect, the present invention is directed to a method of installing a sand control screen assembly in a subterranean well. The method includes running the sand control screen assembly to a target location within the subterranean well, contacting a swellable material layer disposed exteriorly on a base pipe with an activating fluid, the swellable material layer and the base pipe having corresponding openings, radially expanding the swellable material layer in response to contact with the activating fluid and radially outwardly extending telescoping perforations having filter media that are operably associated with the openings of the base pipe and at least partially disposed within the corresponding openings of the swellable material layer, in response to the radial expansion of the swellable material layer.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1A:
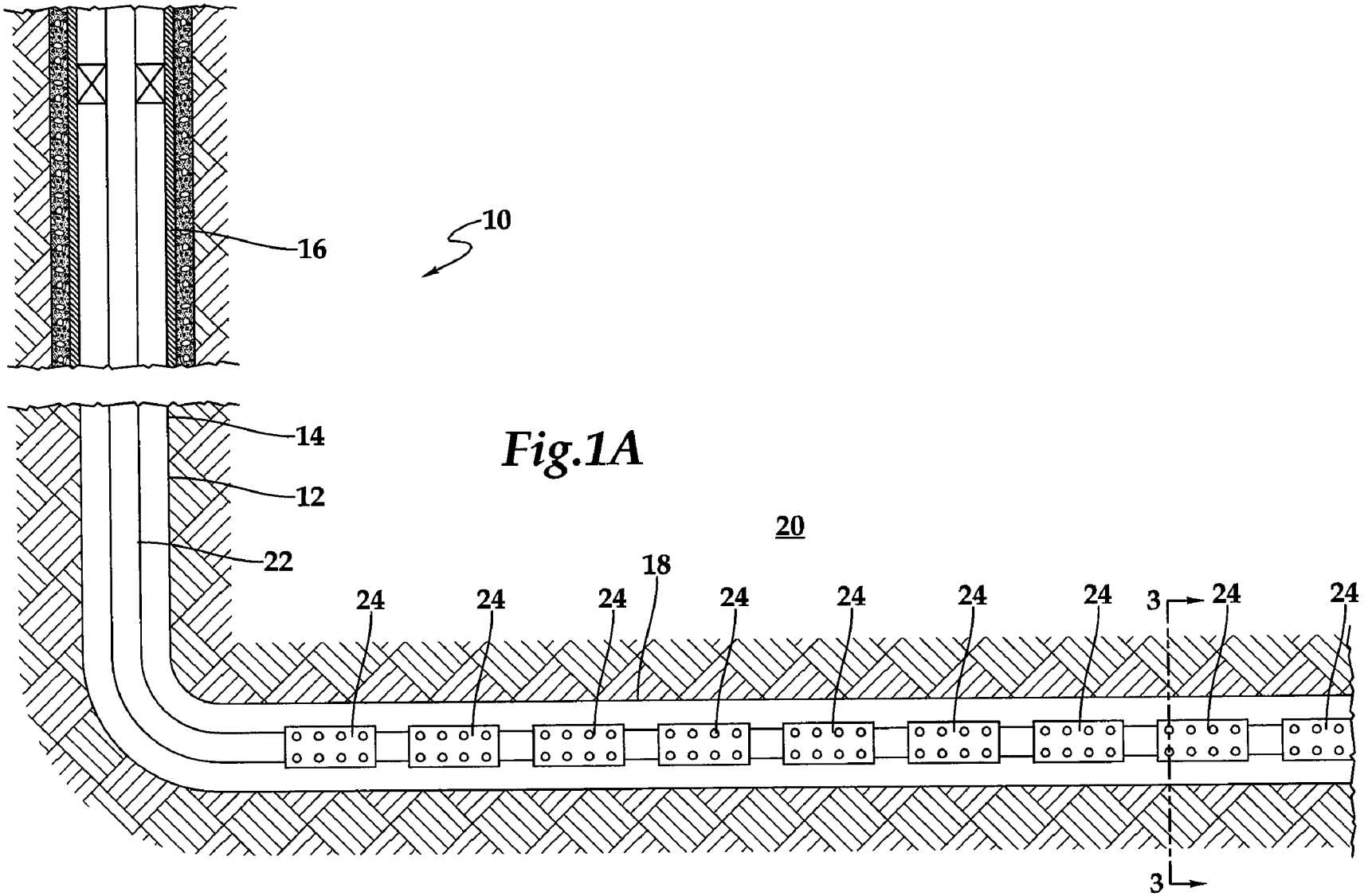
FIG. 1A is a schematic illustration of a well system operating a plurality of sand control screen assemblies in a run in configuration according to an embodiment of the present invention.

Referring initially to FIG. 1A, therein is depicted a well system including a plurality of sand control screen assemblies embodying principles of the present invention that are schematically illustrated and generally designated 10. In the illustrated embodiment, a wellbore 12 extends through the various earth strata. Wellbore 12 has a substantially vertical section 14, the upper portion of which has installed therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface. Positioned within tubing string 22 is a plurality of sand control screen assemblies 24. The sand control screen assemblies 24 are shown in a run in or unextended configuration.

Figure 1B:
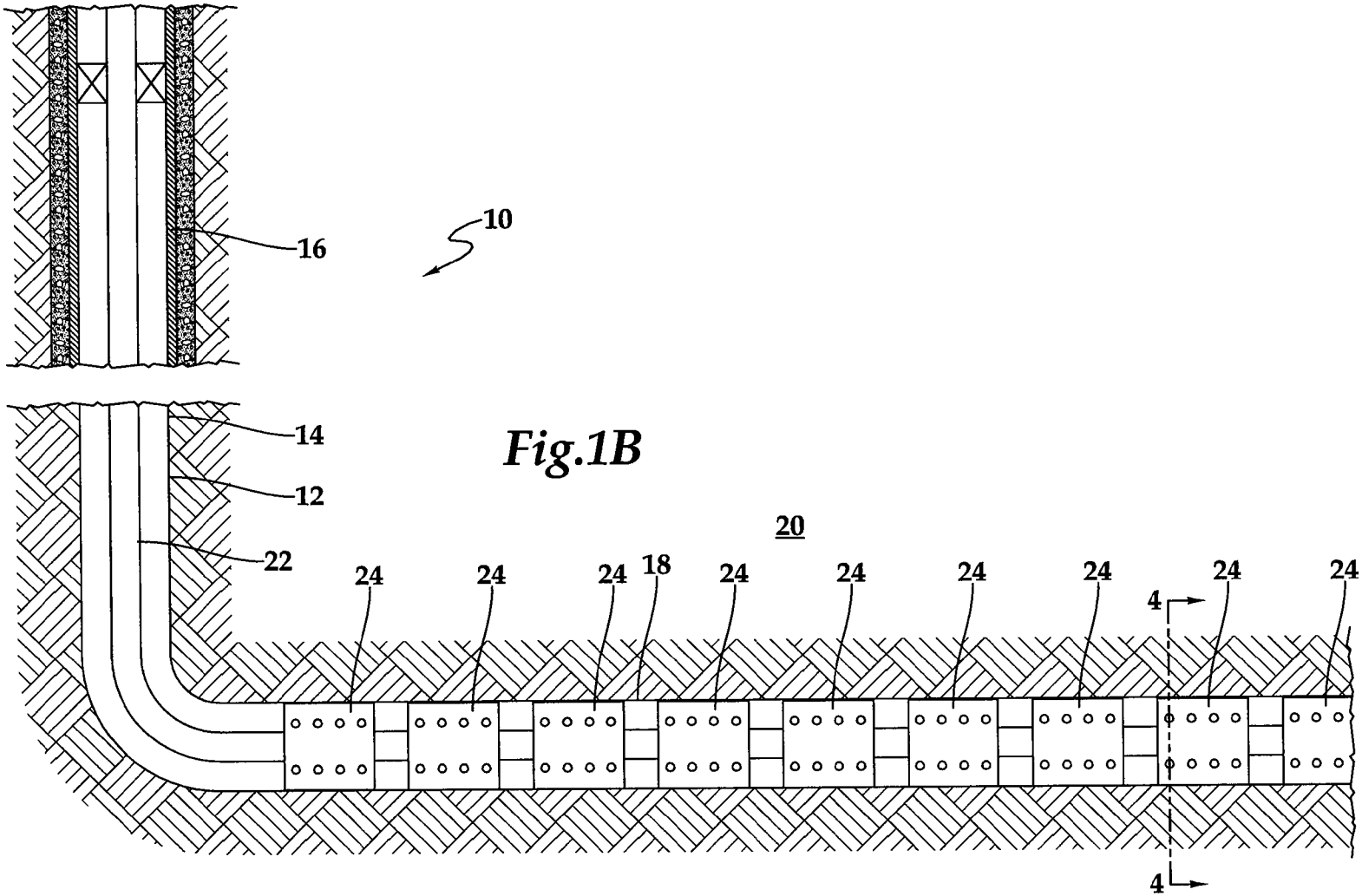
FIG. 1B is a schematic illustration of the well system operating a plurality of sand control screen assemblies in an operating configuration according to an embodiment of the present invention.

Referring next to FIG. 1B, therein is depicted the well system of FIG. 1A with sand control screen assemblies 24 in their radially expanded configuration. As explained in greater detail below, when the swellable material layer of sand control screen assemblies 24 come in contact with an activating fluid, such as a hydrocarbon fluid, the swellable material layer radially expands which in turn causes telescoping perforations of sand control screen assemblies 24 to radially outwardly extend. Preferably, as illustrated in FIG. 1B, swellable material layer and telescoping perforations come in contact with formation 20 upon expansion.

Figure 2A:
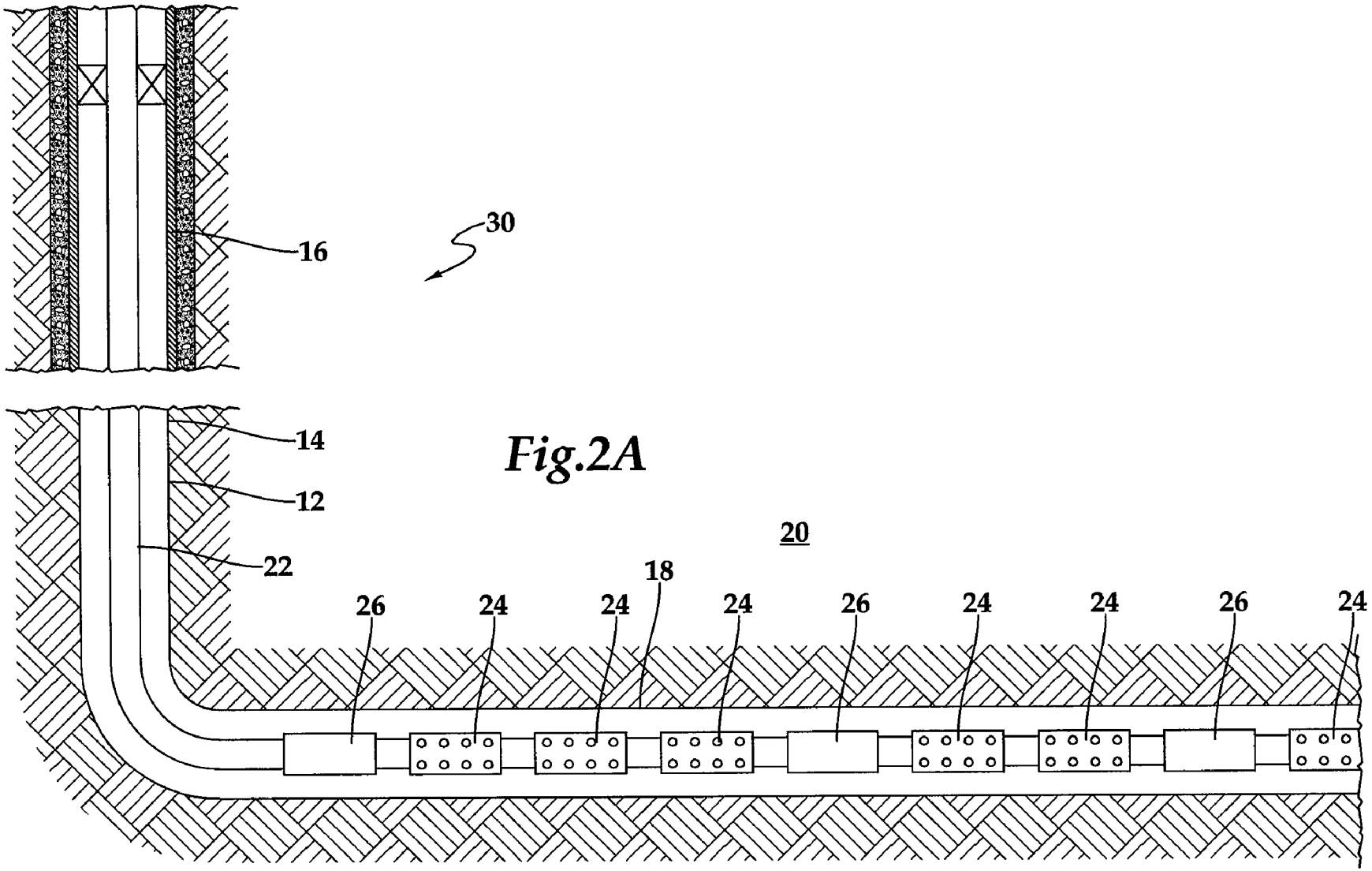
FIG. 2A is a schematic illustration of a well system operating a plurality of sand control screen assemblies in a run in configuration according to an embodiment of the present invention.
Figure 2B:
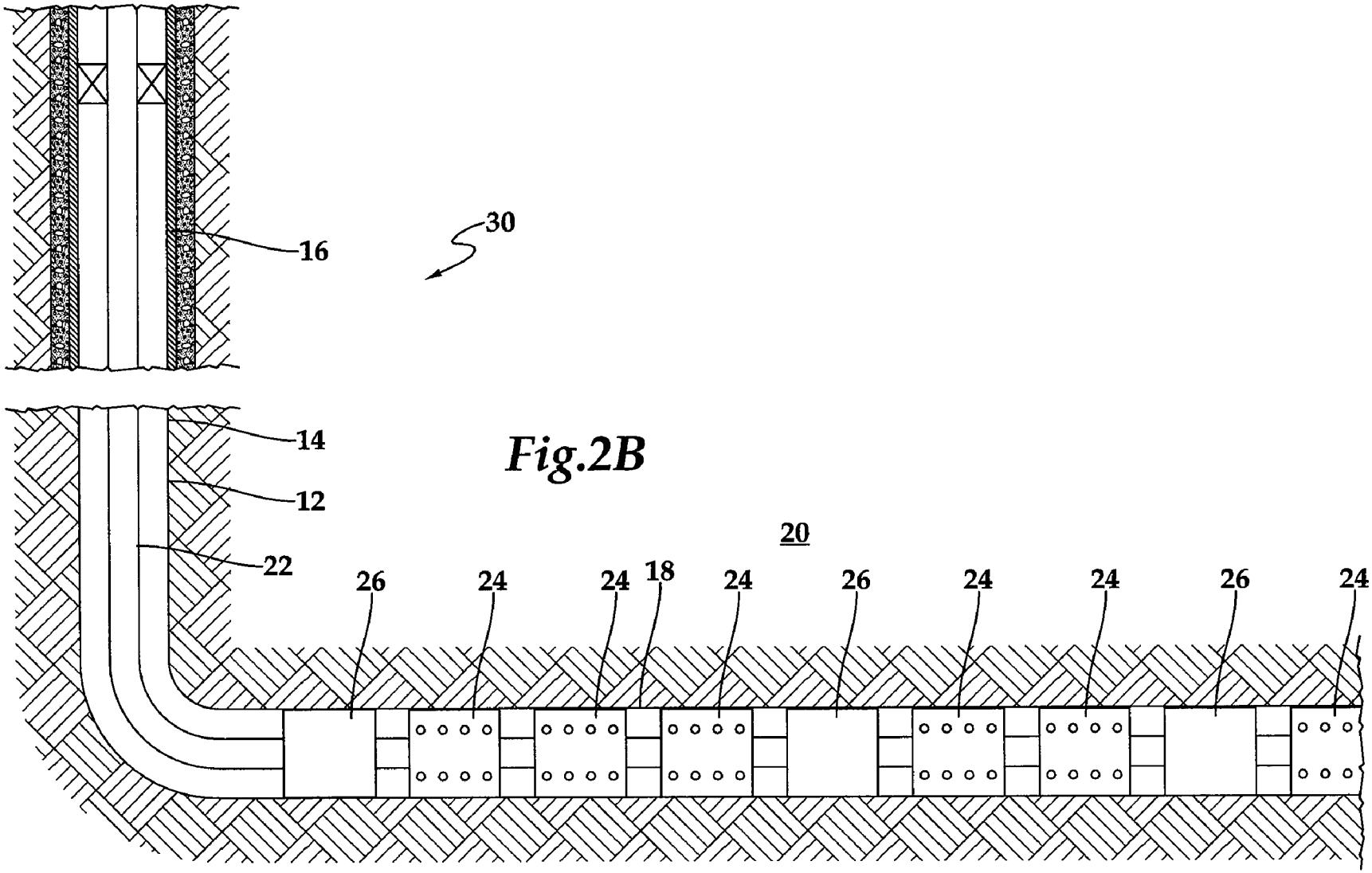
FIG. 2B is a schematic illustration of a well system operating a plurality of sand control screen assemblies in an operating configuration according to an embodiment of the present invention.

Referring to FIGS. 2A-2B, therein is depicted a well system including a plurality of sand control screen assemblies 24 embodying principles of the present invention that are schematically illustrated and generally designated 30. In addition to those elements located in FIG. 2A common to FIGS. 1A-1B, the tubing string 22 may further be divided up into a plurality of intervals using zone isolation devices and/or swellable zone isolation devices 26 or other sealing devices, such as packers, between adjacent sand control screen assemblies 24 or groups of sand control screen assemblies 24. The zone isolation devices 26 may swell between the tubing string 22 and the wellbore 12 in horizontal section 18, as depicted in FIG. 2B, to provide zone isolation for those adjacent sand control screen assemblies 24 or groups of sand control screen assemblies 24 located between one or more zone isolation devices 26.

These zone isolation devices 26 may be made from materials that swell upon contact by a fluid, such as an inorganic or organic fluid. Some exemplary fluids that may cause the zone isolation devices 26 to swell and isolate include water and hydrocarbons.

In addition, even though FIGS. 1A-2B depict the sand control screen assemblies of the present invention in a horizontal section of the wellbore, it should be understood by those skilled in the art that the sand control screen assemblies of the present invention are equally well suited for use in deviated or vertical wellbores. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 3:
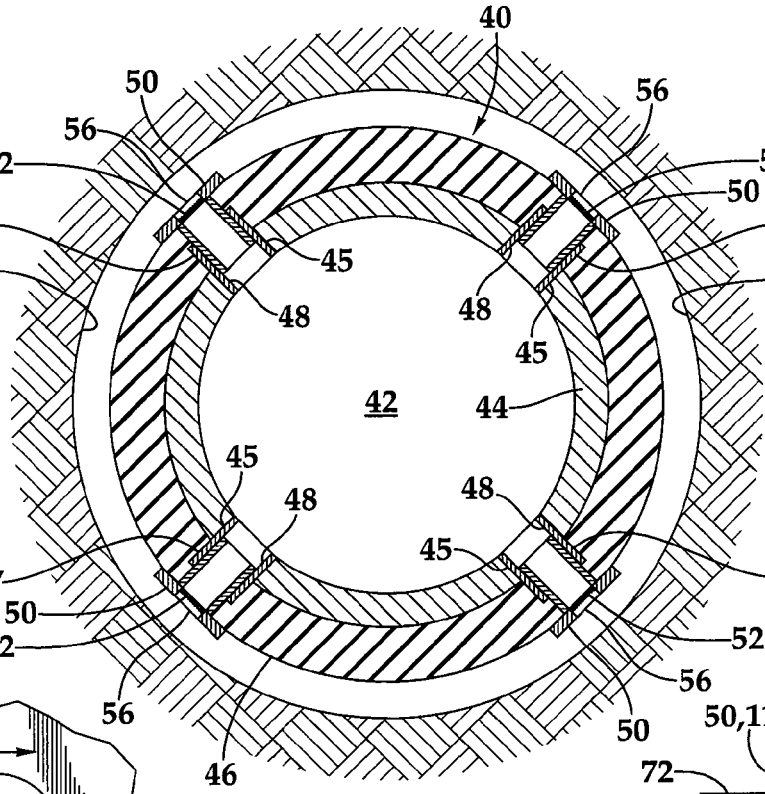
FIG. 3 is a cross sectional view taken along line 3-3 of the sand control screen assembly of FIG. 1A.

Referring to FIG. 3, therein is depicted a cross sectional view of a sand control screen assembly in its run in configuration that embodies principles of the present invention and is generally designated 40. Sand control screen assembly 40 includes base pipe 44 that defines an internal flow path 42. Base pipe 44 has a plurality of openings 45 that allow fluid to pass between the exterior of base pipe 44 and internal flow path 42. Sand control screen assembly 40 includes a concentric layer of swellable material 46 that circumferentially surrounds base pipe 44. Swellable material 46 has a plurality of openings 47 that correspond to openings 45 of base pipe 44. In the illustrated embodiment, sand control screen assembly 40 includes a plurality of telescoping perforations 48. The proximal ends of the telescoping perforations 48 are connected to the base pipe 44 by means of threading, welding, friction fit or the like. The distal ends of the telescoping perforations 48 terminate at a face plate 50 that is positioned exterior of or embedded in the exterior surface of swellable material 46. Telescoping perforations 48 provide a fluid conduit or passageway between the distal ends and the proximal ends of the telescoping perforations 48 that passes through swellable material 46 and base pipe 44. Disposed within each telescoping perforation 48 is a filter media 52.

Figure 4:
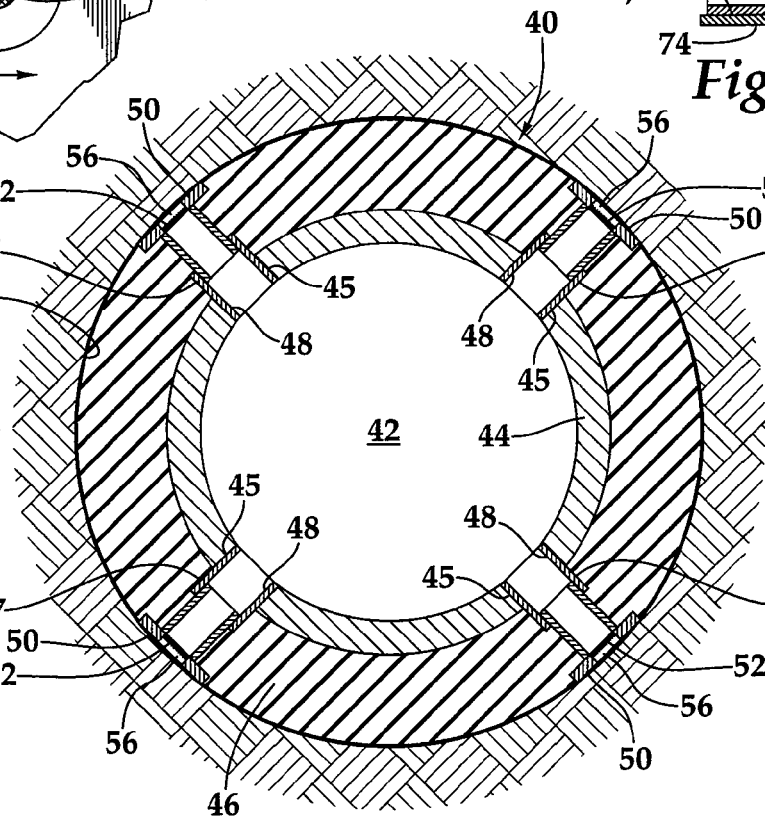
FIG. 4 is a cross sectional view taken along line 4-4 of the sand control screen assembly of FIG. 1B.

The filter media 52 may comprise a mechanical screening element such as a fluid-porous, particulate restricting, metal screen having a plurality of layers of woven wire mesh that may be diffusion bonded or sintered together to form a porous wire mesh screen designed to allow fluid flow therethrough but prevent the flow of particulate materials of a predetermined size from passing therethrough. Alternatively, filter media 52 may be formed from other types of sand control medium, such as gravel pack material, metallic beads such as stainless steel beads or sintered stainless steel beads and the like Referring additionally now to FIG. 4, therein is depicted a cross sectional view of sand control screen assembly 40 in its operating configuration. In the illustrated embodiment, swellable material 46 has come in contact with an activating fluid, such as a hydrocarbon fluid, that has caused swellable material 46 to radially expand into contact with the surface of the wellbore 54, which in the illustrated embodiment is the formation face. In addition, the radial expansion of swellable material 46 has caused telescoping perforations 48 to radially outwardly extend into contact with the surface of the wellbore 54. In this embodiment, a stand off region 56 is provided between filter media 52 and wellbore 54 such that filter media 52 does not come into physical contact with the surface of the formation.

Figure 5:
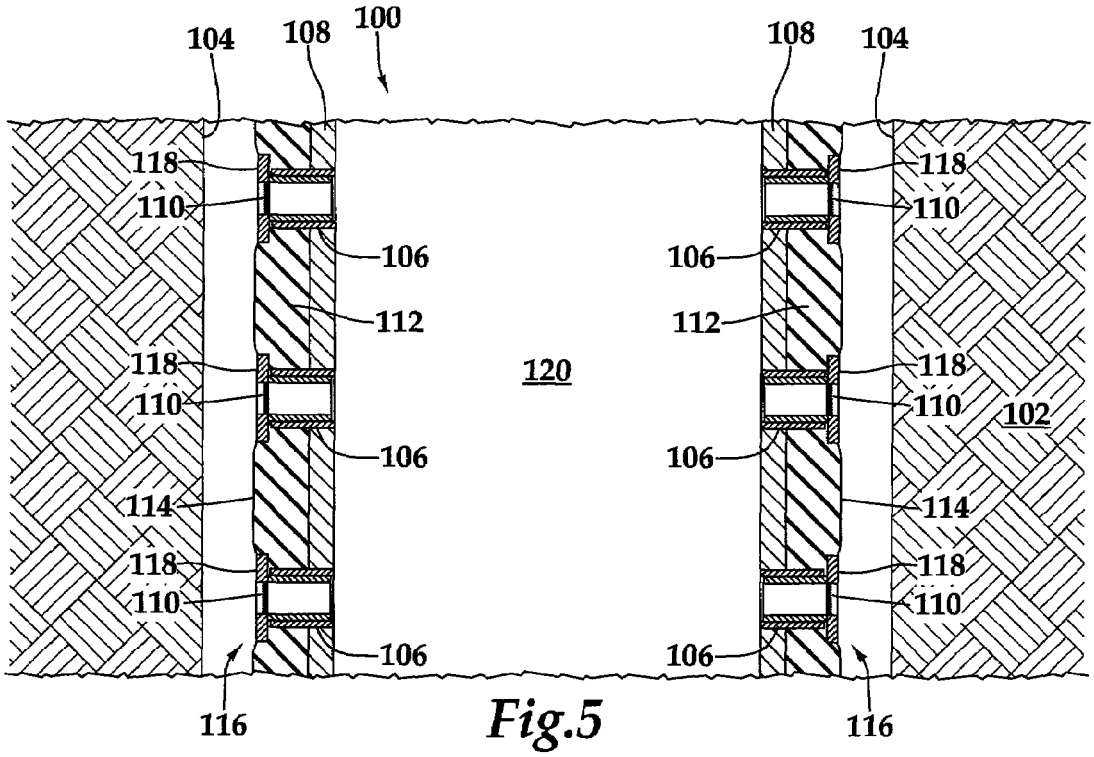
FIG. 5 is a side view of a sand control screen assembly in a run in configuration according to an embodiment of the present invention.

Referring next to FIG. 5, therein is depicted a side view of a sand control screen assembly in its run in configuration that embodies principles of the present invention and is generally designated 100. In this embodiment, the sand control screen assembly 100 is located within an open hole portion of formation 102 having a surface 104. The sand control screen assembly 100 includes one or more telescoping perforations 106 that are shown in an unextended position.

The sand control screen assembly 100 includes a concentric layer of swellable material 112 that surrounds a base pipe 108 having an interior flow path 120. In one aspect, the telescoping perforations 106 include a face plate 118 and a filter medium 110. The swellable material 112 includes an outer surface 114. In the illustrated embodiment, face plates 118 are embedded within swellable material 112 such that a substantially smooth outer surface is established in the run in configuration. Located between the outer surface 114 and the surface 104 of the formation 102 is an annular region 116.

Figure 6:
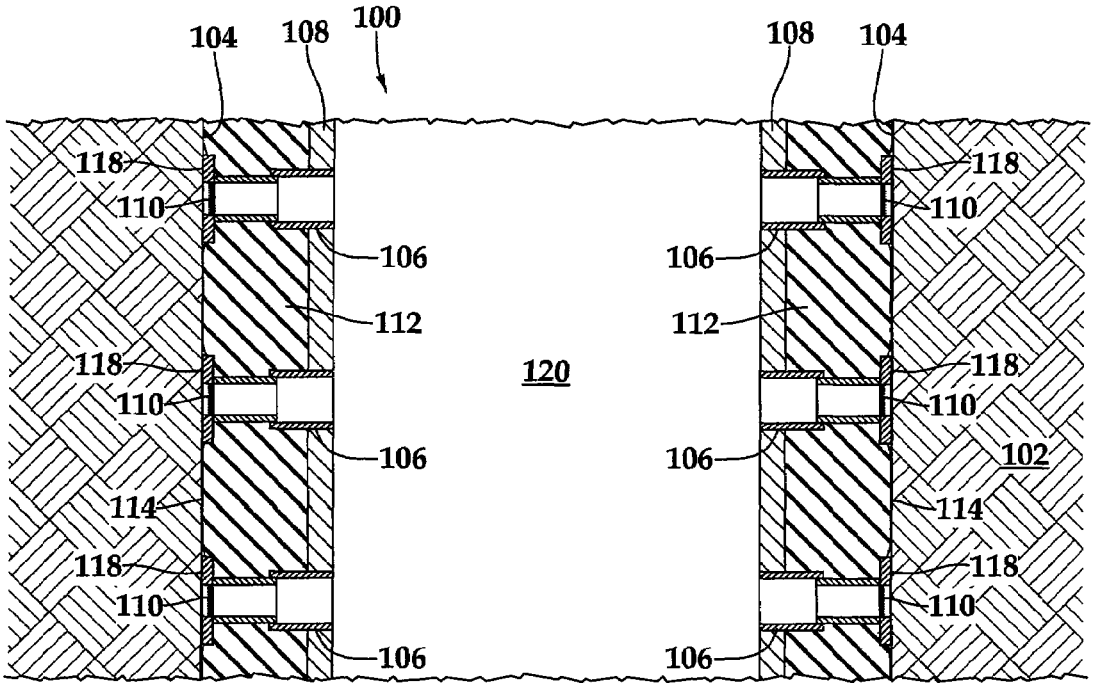
FIG. 6 is a side view of a sand control screen assembly in an operating configuration according to an embodiment of the present invention.

Referring additionally to FIG. 6, therein is depicted a cross sectional view of sand control screen assembly 100 in its operating configuration. The swellable material 112 has come in contact with an activating fluid, such as a hydrocarbon fluid, that has caused swellable material 112 to radially expand into contact with the surface 104 of the formation 102. Likewise, the radial expansion of swellable material 112 has caused telescoping perforations 106 to radially outwardly extend into contact with the surface 104 of the formation 102. In this embodiment, filter medium 110 does not come into contact with the surface 104 of the formation 102 due to a stand off region of face plate 118. Preferably, the outer surface 114 of the swellable material 112 does contact the surface 104 of the formation 102.

Figure 7A:
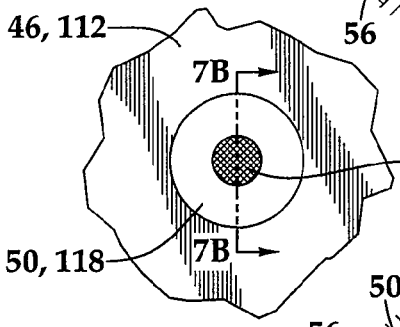
FIG. 7A is a side view of a portion of a sand control screen assembly depicting the top of a telescoping perforation according to an embodiment of the present invention.

Referring additionally to FIG. 7A, therein is depicted a distal end view of a portion of swellable material 46, 112, a face plate 50, 118 and a filter media 52, 110 of a sand control screen assembly 40, 100. As illustrated, face plate 50, 118 is positioned on the exterior surface of swellable material 46, 112 (see also FIGS. 3-6). As swellable material 46, 112 surrounds the telescoping portions of telescoping perforations 48, 106 and as face plates 50, 118 have a diameter that is larger than the diameter of the telescoping portions of telescoping perforations 48, 106, radial expansion of the swellable material 46, 112 applies a radially outwardly directed force on face plates 50, 118 which in turn causes telescoping perforations 48, 106 to radially extend toward the surface 58, 104 of the formation 54, 102.

Figure 7B:
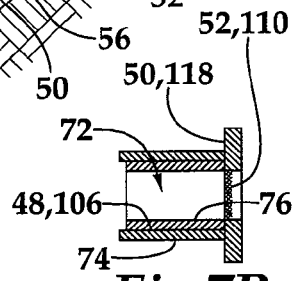
FIG. 7B is a cross sectional view taken along line 7B-7B of the telescoping perforation of FIG. 7A.

Referring to FIG. 7B, telescoping perforation 48, 106 has an outer tubular element 74 and an inner tubular element 76. Preferably, outer tubular element 74 is connected to the base pipe 44, 108 by threading or other suitable means. Inner tubular element 76 is connected to face plate 50, 118. In this manner, when the radially outwardly directed force is applied to face plate 50, 118, inner tubular element 76 telescopes radially outwardly relative to outer tubular element 74. Together, inner and outer tubular elements 74, 76 of telescoping perforation 48, 106 defines an internal flow path 72. Positioned within internal flow path 72 is the filter media 52, 110 which may be a mechanical screening element or other suitable filter member that is sized according to the particular requirements of the production zone into which it will be installed. Some exemplary sizes of the filter media 52 may be 20, 30, and 40 standard mesh sizes.

Even though FIGS. 3-7B have depicted telescoping perforations 48, 106 as having inner and outer tubular elements 74, 76, it should be understood by those skilled in the art that other configurations of nested telescoping elements could alternatively be used in telescoping perforations 48, 106 without departing from the principles of the present invention. In addition, it should be noted that any number of telescoping perforations 48, 106 may be located on base pipe 44, 108 and they may be positioned at any desirable location on the circumference of base pipe 44, 108.

Preferably, when telescoping perforations 48, 106 are fully extended, a stand off distance remains between the filter media 52, 110 and the surface 58, 104 of the formation 54, 102. For example, if a filter cake has previously formed on the surface 58, 104 of the formation 54, 102, then the stand off will prevent damage to the filter media 52, 110 and allow removal of the filter cake using acid or other reactive fluid.

Figure 8:
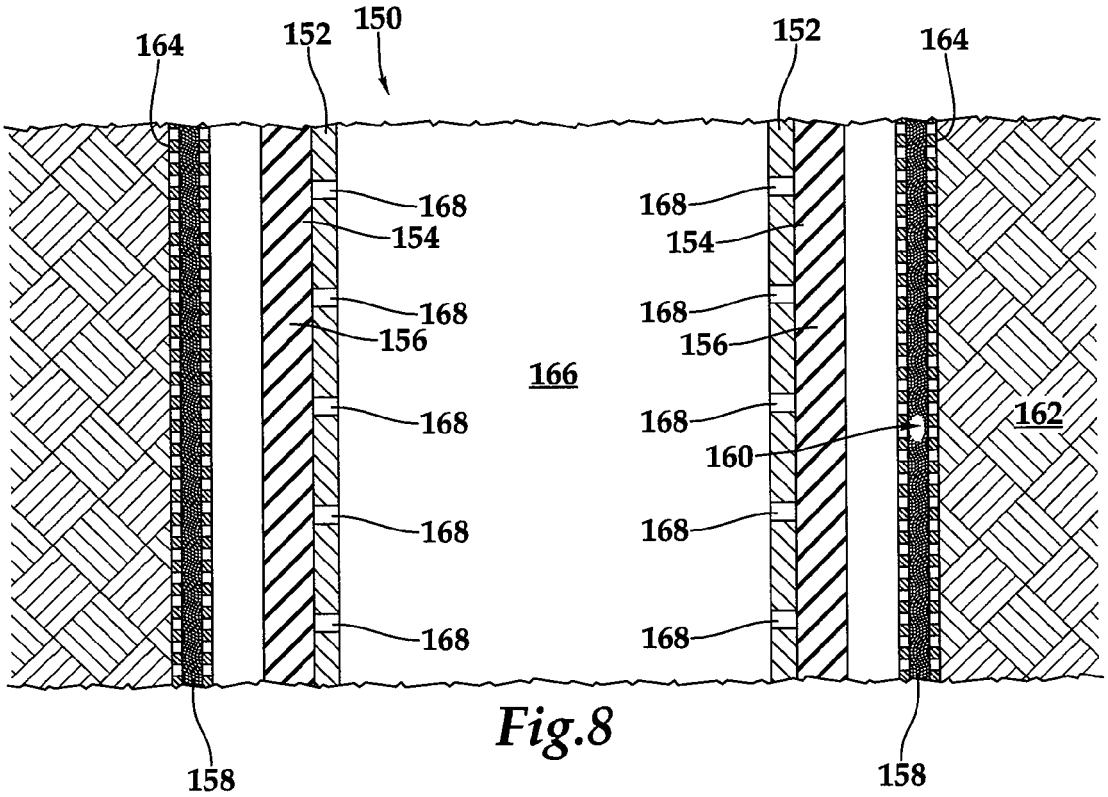
FIG. 8 is a side view of a sand control screen assembly in a run in configuration according to an embodiment of the present invention.

Referring to FIG. 8, therein is depicted a side view of a sand control screen assembly 150 in an unextended position. The sand control screen assembly 150 includes a concentric layer of swellable material 154 that circumferentially surrounds a base pipe 152 having an interior flow path 166. The base pipe 152 preferably includes a plurality of openings 168 that are in fluid communication with the swellable material 154 for providing a fluid conduit between the formation 162 and the interior flow path 166. In the illustrated embodiment, an expandable control screen 158 was previously installed in the open hole completion such that expandable control screen 158 is positioned against the surface 164 of the formation 162. Expandable sand screen 158 is a fluid-porous, particulate restricting, metal material such as a plurality of layers of a wire mesh that may be diffusion bonded or sintered together to form a fluid porous wire mesh screen. Expandable sand screen 158, includes inner and outer tubulars that protect the filter media. As shown, expandable sand screen 158 has an open section 160 where the screen has been worn through or damaged, which allows sand production into the wellbore.

Figure 9:
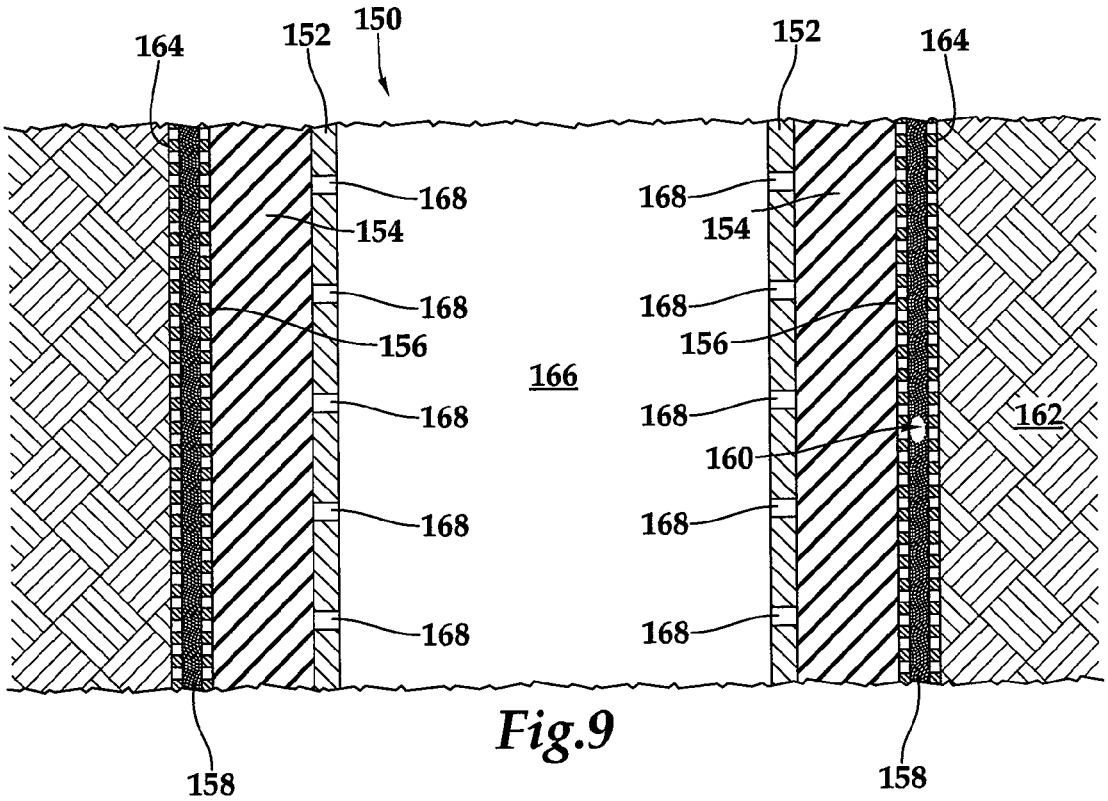
FIG. 9 is a side view of a sand control screen assembly in an operating configuration according to an embodiment of the present invention.

Referring additionally to FIG. 9, therein is depicted a side view of sand control screen assembly 150 in an extended position. Specifically, the swellable material 154 has expanded such that the outer surface 156 of swellable material 154 contacts the inner surface of sand screen 158. This expansion has occurred in response to swellable material 154 contacting an activation fluid such as a hydrocarbon fluid as described herein. As shown, the open section 160 of expandable sand screen 158 is now isolated such that sand production through open section 160 is now prevented and the failed section of expandable sand screen 158 is repaired. As such, in embodiments in which swellable material 154 is not permeable, sand control screen assembly 150 may be placed down hole as a patch inside the damaged sand screen 158. Alternatively, in embodiments in which swellable material 154 is fluid permeable but particulate resistant, production fluid may pass through swellable material 154 and openings 168 of base pipe 152 into interior flow path 166.

Figure 10:
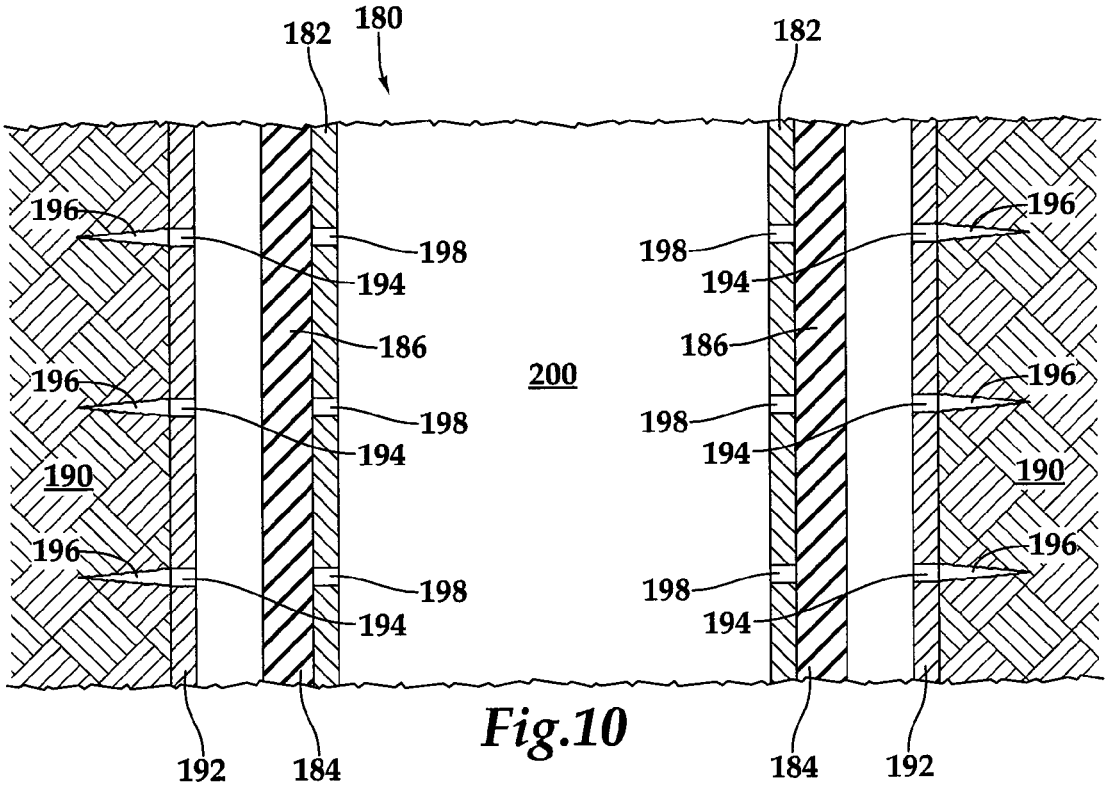
FIG. 10 is a side view of a sand control screen assembly in a run in configuration according to an embodiment of the present invention.
Figure 11:
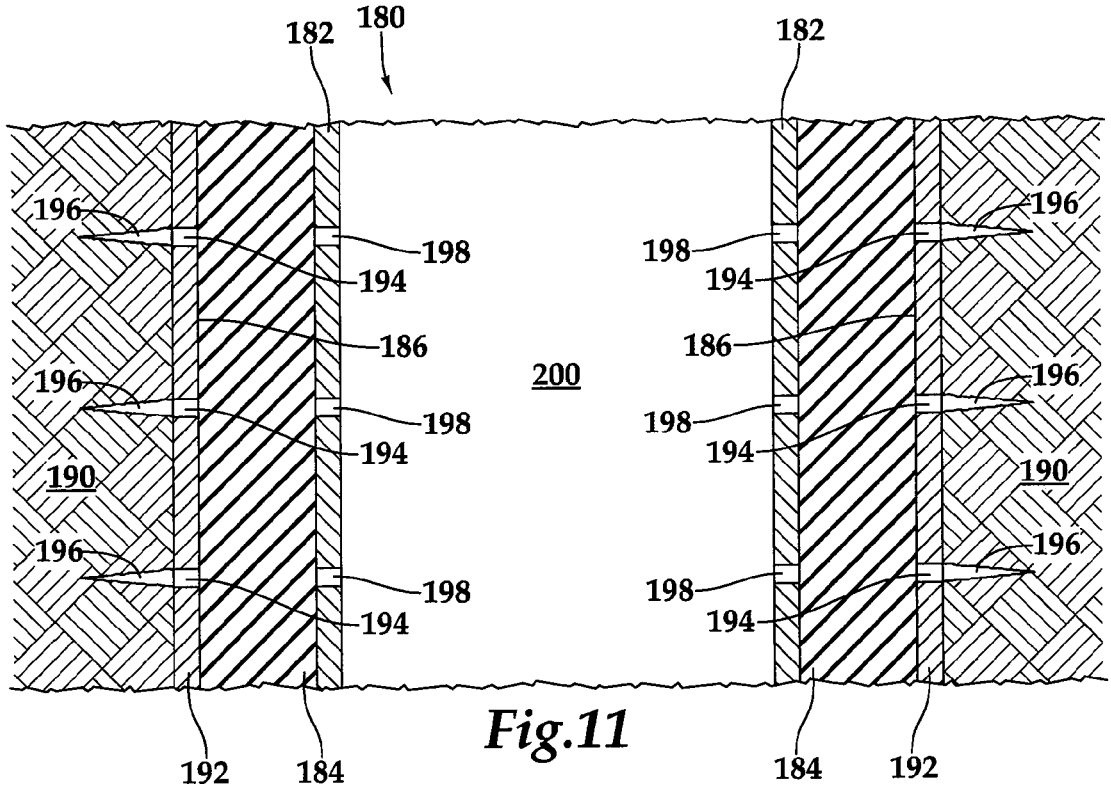
FIG. 11 is a side view of a sand control screen assembly in an operating configuration according to an embodiment of the present invention.

Referring to FIGS. 10-11, therein is depicted a side view of a sand control screen assembly 180 in an unextended and an extended position, respectively. In the illustrated embodiment, sand control screen assembly 180 is positioned in a cased wellbore adjacent to formation 190. Casing 192 has previously been perforated as indicated at 196 which created a plurality of openings 194 through casing 192. Sand control screen assembly 180 includes a concentric layer of swellable material 184 that circumferentially surrounds the base pipe 182. Base pipe 182 includes a plurality of openings 198 and defines an interior flow path 200. As seen in FIG. 11, the swellable material 184 has expanded such that the outer surface 186 of swellable material 184 contact the inner surface of casing 192. This expansion has occurred in response to swellable material 184 contacting an activation fluid such as a hydrocarbon fluid as described herein. In the illustrated embodiment, the swellable material 184 may serve as a packer to prevent fluid production and particulate production from the interval associated with casing 192. Alternatively, swellable material 184 may be fluid permeable and particulate resistant such that production fluid may pass through swellable material 184 and openings 198 of base pipe 182 into interior flow path 200.

The above described swellable materials such as swellable materials 46, 112, 154, 184 are materials that swells when contacted by an activation fluid, such as an inorganic or organic fluid. In one embodiment, the swellable material is a material that swells upon contact with and/or absorption of a hydrocarbon, such as oil. The hydrocarbon is absorbed into the swellable material such that the volume of the swellable material increases creating a radial expansion of the swellable material when positioned around a base pipe which creates a radially outward directed force that may operate to radially extend telescoping perforations as described above. Preferably, the swellable material will swell until its outer surface contacts the formation face in an open hole completion or the casing wall in a cased wellbore. The swellable material accordingly provides the energy to extend the telescoping perforations to the surface of the formation.

Some exemplary swellable materials include elastic polymers, such as EPDM rubber, styrene butadiene, natural rubber, ethylene propylene monomer rubber, ethylene propylene diene monomer rubber, ethylene vinyl acetate rubber, hydrogenized acrylonitrile butadiene rubber, acrylonitrile butadiene rubber, isoprene rubber, chloroprene rubber and polynorbornene. These and other swellable materials swells in contact with and by absorption of hydrocarbons so that the swellable materials expands. In one embodiment, the rubber of the swellable materials may also have other materials dissolved in or in mechanical mixture therewith, such as fibers of cellulose. Additional options may be rubber in mechanical mixture with polyvinyl chloride, methyl methacrylate, acrylonitrile, ethylacetate or other polymers that expand in contact with oil.

In some embodiments, the swellable materials may be permeable to certain fluids but prevent particulate movement therethrough due to the porosity within the swellable materials. For example, the swellable material may have a pore size that is sufficiently small to prevent the passage of the sand therethrough but sufficiently large to allow hydrocarbon fluid production therethrough. For example, the swellable material may have a pore size of less than 1 mm.

Figure 12:
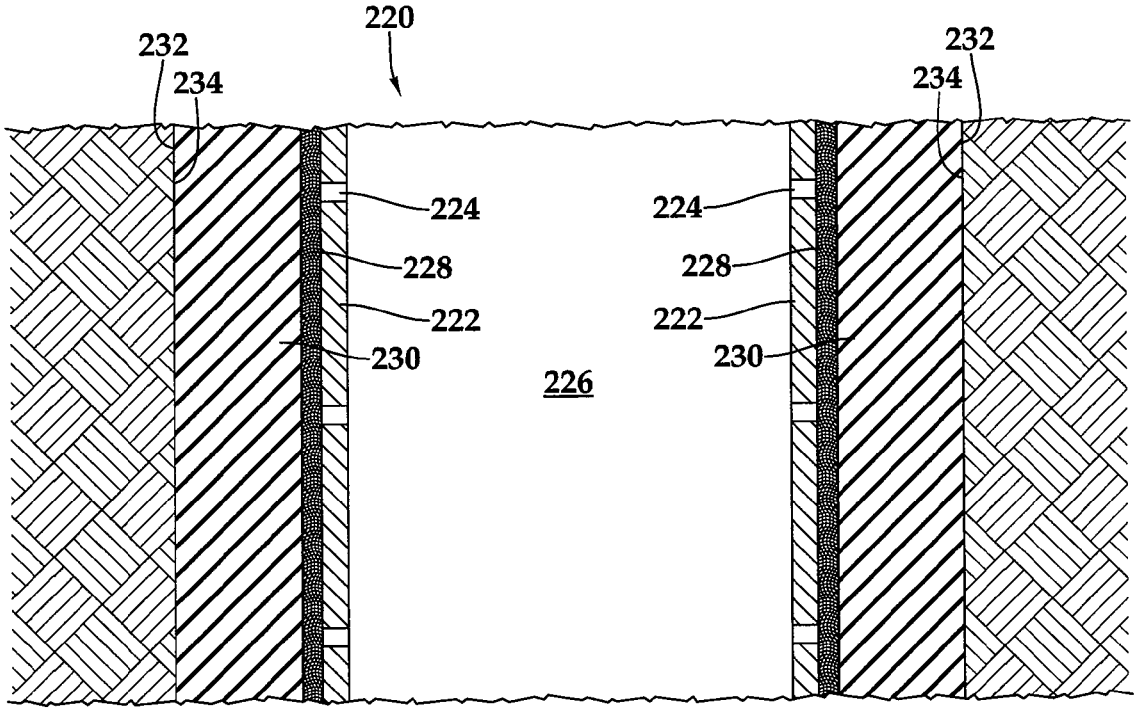
FIG. 12 is a side view of a sand control screen assembly in an operating configuration according to an embodiment of the present invention.

Referring to FIG. 12, therein is depicted a side view of a sand control screen assembly 220 in an expanded configuration. Sand control screen assembly 220 includes a base pipe 222 that has a plurality of openings 224 and defines an interior flow path 226. Positioned concentrically around base pipe 222 is a filter medium 228. Filter medium 228 is depicted as a fluid-porous, particulate restricting, metal material such as a plurality of layers of a wire mesh that may be diffusion bonded or sintered together to form a fluid porous wire mesh screen. Those skilled in the art will understand that other types of filter media could alternatively be used in sand control screen assembly 220 such as a wire wrap screen, a sand packed screen or the like. Sand control screen assembly 220 also includes a layer of swellable material 230 that circumferentially surrounds filter medium 228. Collectively, filter medium 228 and swellable material 230 may be referred to as a swellable filter media.

In a manner similar to that described above, sand control screen assembly 220 is run downhole with swellable material 230 in its unexpanded configuration. As seen in FIG. 12, the swellable material 230 has expanded such that the outer surface 232 of swellable material 230 contacts the surface of the open hole wellbore 234. This expansion has occurred due to swellable material 230 contacting an activation fluid such as a hydrocarbon fluid as described herein. In the illustrated embodiment, the swellable material 230 is permeable to fluids and, in some embodiments, permeable to certain particulate materials which are prevented from entering the interior flow path 226 of base pipe 222 by filter media 228.

Figure 13:
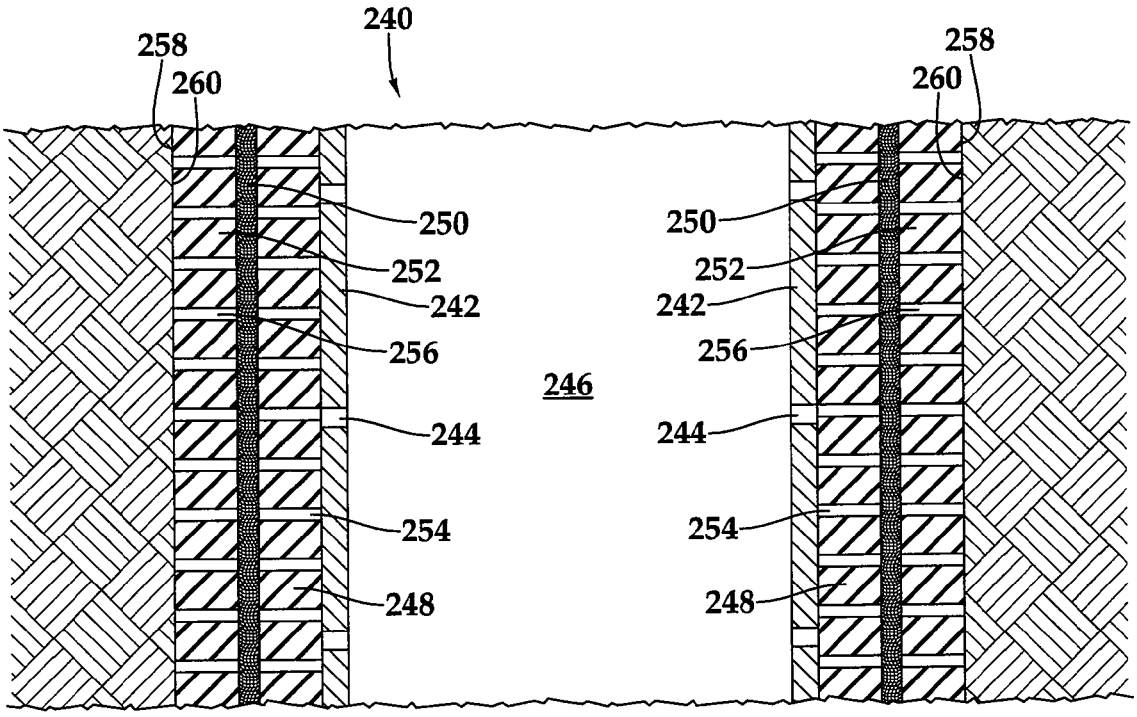
FIG. 13 is a side view of a sand control screen assembly in an operating configuration according to an embodiment of the present invention.

Referring to FIG. 13, therein is depicted a side view of a sand control screen assembly 240 in an expanded configuration. Sand control screen assembly 240 includes a base pipe 242 that has a plurality of openings 244 and defines an interior flow path 246. Positioned concentrically around base pipe 242 is a layer of swellable material 248. Positioned concentrically around swellable material 248 is a filter medium 250. Filter medium 250 is depicted as a fluid-porous, particulate restricting, metal material such as a plurality of layers of a wire mesh that may be diffusion bonded or sintered together to form a fluid porous wire mesh screen. Those skilled in the art will understand that other types of filter media could alternatively be used in sand control screen assembly 220 such as a wire wrap screen, sand packed screen or the like. Sand control screen assembly 240 also includes a layer of swellable material 252 that circumferentially surrounds filter medium 250. Swellable material 248 includes a plurality of perforations 254 and swellable material 252 includes a plurality of perforations 256. Collectively, filter medium 250 and swellable materials 248, 252 may be referred to as a swellable filter media.

In a manner similar to that described above, sand control screen assembly 240 is run downhole with swellable materials 248, 252 in their unexpanded configuration. As seen in FIG. 13, swellable materials 248, 252 have expanded such that the outer surface 258 of swellable material 252 contacts the surface of the open hole wellbore 260. This expansion has occurred due to swellable materials 248, 252 contacting an activation fluid such as a hydrocarbon fluid as described herein.

Figure 14:
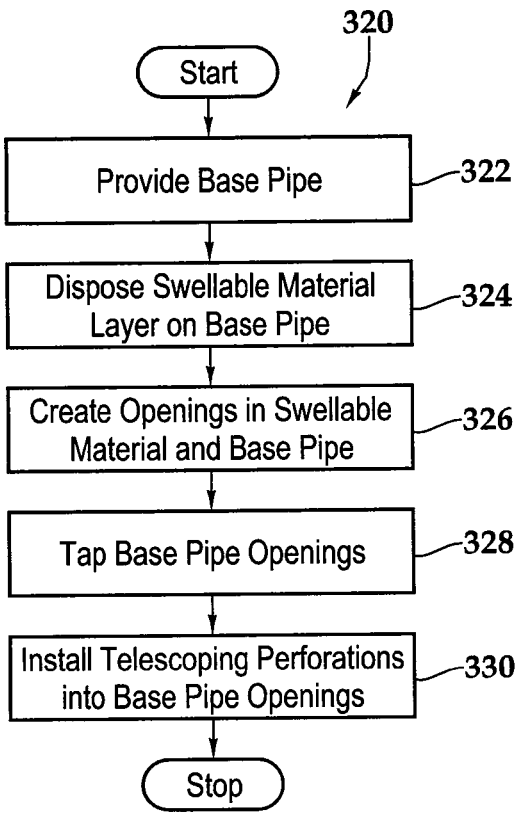
FIG. 14 is a flow diagram of a process for making a sand control screen assembly according to an embodiment of the present invention.

In addition to the aforementioned aspects and embodiments of the present sand control screen assemblies, the present invention further includes methods for making a sand control screen assembly. FIG. 14 illustrates an embodiment 320 of an exemplary process for making a sand control screen assembly. In step 322, a base pipe is provided of a desired length for use in a desired application. In step 324, a coating of swellable material is disposed on the exterior of the base pipe. This step may include any type of application process appropriate for the swellable materials disclosed herein, including: dipping, spraying, wrapping, applying and the like. Generally, the swellable material is applied in a desired length on the base pipe according to the desired application in the wellbore. Also, the location of the swellable material on the base pipe may be determined by where the base pipe will be in the wellbore in relation to the production areas.

In step 326, openings are created in the swellable material. This step may be performed by removing those portions of the swellable material by drilling, cutting and the like. In this step, corresponding portions of the base pipe may also be removed to create holes in the base pipe using the same or a different drilling or cutting process.

In step 328, the holes in the base pipe may be tapped or threaded for acceptance of the telescoping perforations. In step 330, the telescoping perforations, including face plates, are installed through the removed portions of the swellable material and threaded into the tapped holes of the base pipe to complete the sand control screen assembly.

Figure 15:
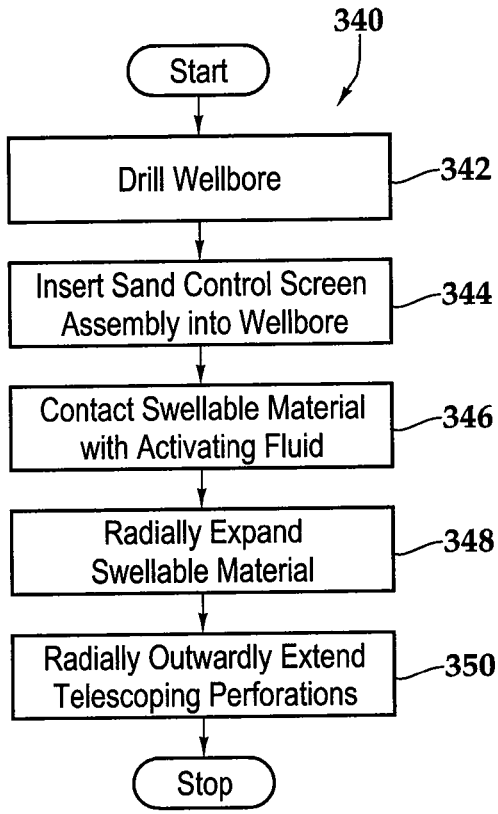
FIG. 15 is a flow diagram of a process for installing and operating a sand control screen assembly according to an embodiment of the present invention.

FIG. 15 illustrates an embodiment 340 of an exemplary process for controlling sand and hydrocarbon production from a production interval. In step 342, a wellbore is drilled such that is traverses a subterranean hydrocarbon bearing formation. This step may include placing various casings or liners in the wellbore and performing various other well construction activities prior to insertion of the work string including one or more sand control screen assemblies of the present invention. In step 344, one or more sand control screen assemblies are inserted into the wellbore and the sand control screen assemblies are positioned adjacent to their respective production intervals. In this step, the sand control screen assemblies are preferably run into a hole with a smooth inner bore and smooth outer bore to minimize the risk of getting stuck.

In step 346, an activating fluid, such as a hydrocarbon, contacts the sand control screen assemblies and they expand, extend and/or swell radially outwards to come in contact with the surface of the formation of the wellbore. In those embodiments including telescoping perforations, steps 348 and 350 involve radially expanding the swellable material of the sand control screen assemblies which creates a outward radial force on the face plates such that telescoping perforations radially extend.

At this point, the wellbore is highly suitable for post treatment stimulation as there are no restrictions inside the wellbore. Further, it is not necessary to pump gravel or cement to achieve effective zone isolation and sand control. As described above, this process may further include incorporating blank packers, including swell packers, in the work string to further isolate desired sections of the wellbore making it possible to complete long, heterogeneous intervals.

The available flow area can be regulated by the density and size of the telescoping perforations used. In any of the steps above, packers may be set up to run control lines or fiber optics. Thus, it may be further configured to include fiber optics for continuous temperature and pressure monitoring as well as other control lines to perform smart well functions.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly comprising:

a base pipe having at least one opening in a sidewall portion thereof;

a swellable material layer disposed exteriorly of the base pipe and having at least one opening corresponding to the at least one opening of the base pipe;

a telescoping perforation operably associated with the at least one opening of the base pipe and at least partially disposed within the at least one opening of the swellable material layer; and a filter medium disposed within the telescoping perforation, the filter medium recessed radially inwardly from a distal end of the telescoping perforation;

wherein, in response to contact with an activating fluid, radial expansion of the swellable material layer causes the telescoping perforation to radially outwardly extend.

2. The sand control screen assembly as recited in claim 1 further comprising a face plate located at the distal end of the telescoping perforation substantially transverse to a longitudinal axis of the telescoping perforation.

3. The sand control screen assembly as recited in claim 2 wherein the face plate is positioned on the exterior surface of the swellable material layer.

4. The sand control screen assembly as recited in claim 1 wherein the filter medium further comprises a multi-layer woven wire mesh.

5. The sand control screen assembly as recited in claim 1 wherein the telescoping perforation is a telescoping tubular perforation.

6. The sand control screen assembly as recited in claim 1 wherein the activating fluid is at least one of a hydrocarbon fluid and water.

7. The sand control screen assembly as recited in claim 1 wherein the swellable material is selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

8. A sand control screen assembly comprising:

a base pipe having a plurality of circumferentially and longitudinally distributed openings in a sidewall portion thereof and defining an internal flow path;

a swellable material layer disposed exteriorly of the base pipe and having a plurality of openings that correspond to the openings of the base pipe;

a plurality of circumferentially and longitudinally distributed telescoping perforations, each of the telescoping perforations operably associated with one of the openings of the base pipe and at least partially disposed within the corresponding opening of the swellable material layer, the telescoping perforations providing fluid flow paths between a fluid source disposed exteriorly of the base pipe and the interior flow path; and a filter medium disposed within each of the telescoping perforations;

wherein, in response to contact with an activating fluid, radial expansion of the swellable material layer causes the telescoping perforations to radially outwardly extend.

9. The sand control screen assembly as recited in claim 8 wherein the activating fluid is at least one of a hydrocarbon fluid and water.

10. The sand control screen assembly as recited in claim 8 wherein the filter medium further comprises a multi-layer woven wire mesh.

11. The sand control screen assembly as recited in claim 8 wherein the filter medium is recessed radially inwardly from the distal end of the telescoping perforation.

12. The sand control screen assembly as recited in claim 8 wherein the swellable material is selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

13. A method for making a sand control screen assembly comprising:

providing a base pipe having an interior flow path;

disposing a swellable material layer on the exterior of the base pipe;

forming corresponding openings in the base pipe and the swellable material layer; and operably associating a plurality of circumferentially and longitudinally distributed telescoping perforations having filter media with the openings of the base pipe and at least partially disposing the telescoping perforations within the corresponding openings of the swellable material layer such that upon radial expansion of the swellable material layer, the telescoping perforations are radially outwardly extendable.

14. The method as recited in claim 13 wherein the step of forming corresponding openings in the base pipe and the swellable material layer further comprises forming the openings after the swellable material layer is disposed on the exterior of the base pipe.

15. The method as recited in claim 13 wherein the step of forming corresponding openings in the base pipe and the swellable material layer further comprises drilling holes through the swellable material layer and the base pipe.

16. The method as recited in claim 13 wherein the step of operably associating a plurality of circumferentially and longitudinally distributed telescoping perforations having filter media with the openings of the base pipe further comprises threadably coupling the telescoping perforations with the openings of the base pipe.

17. A method of installing a sand control screen assembly in a subterranean well comprising:

running the sand control screen assembly to a target location within the subterranean well;

contacting a swellable material layer disposed exteriorly on a base pipe with an activating fluid, the swellable material layer and the base pipe having corresponding openings;

radially expanding the swellable material layer in response to contact with the activating fluid; and radially outwardly extending circumferentially and longitudinally distributed telescoping perforations having filter media that are operably associated with the openings of the base pipe and at least partially disposed within the corresponding openings of the swellable material layer, in response to the radial expansion of the swellable material layer.

18. The method as recited in claim 17 wherein the step of contacting a swellable material layer with an activating fluid further comprises contacting the swellable material layer with at least one of a hydrocarbon fluid and water.

19. The method as recited in claim 17 wherein the swellable material is selected from the group consisting of elastic polymers, EPDM rubber, styrene butadiene, natural rubber, ethylene propylene monomer rubber, ethylene propylene diene monomer rubber, ethylene vinyl acetate rubber, hydrogenized acrylonitrile-butadiene rubber, acrylonitrile butadiene rubber, isoprene rubber, chloroprene rubber and polynorbornene.

* * * * *